United States Patent [19]

Salens

[11] Patent Number: 4,752,981

[45] Date of Patent: Jun. 28, 1988

[54] DEVICE FOR ADJUSTING FLEXIBLE LATHS RELATIVE TO A BED FRAME

[76] Inventor: Luc Salens, Bogaardestraat 228a, 9990 Maldegem, Belgium

[21] Appl. No.: 919,104

[22] Filed: Oct. 15, 1986

[30] Foreign Application Priority Data

Oct. 16, 1985 [BE] Belgium ..... 215736

[51] Int. Cl.[4] ..... A47C 23/06; A47C 31/00

[52] U.S. Cl. ..... 5/238; 5/11; 5/191

[58] Field of Search ..... 5/238, 236 R, 236 B, 5/191, 11

[56] References Cited

U.S. PATENT DOCUMENTS 4,222,134 9/1980 Degen ..... 5/238
4,251,891 2/1981 Degen ..... 5/191
4,567,615 2/1986 Fantl ..... 5/238

FOREIGN PATENT DOCUMENTS 625115 9/1981 Switzerland .

*Primary Examiner*—Alexander Grosz

[57] ABSTRACT

A device comprised in combination of a lath support, with at least one means for receiving one flexible lath end, and a bearing to be secured to the bed frame, which has at least one pin which fits into the one of at least two cavities lying above one another in said lath support, in such a way that adjusting the height of a flexible lath relative to said bed frame becomes possible.

11 Claims, 4 Drawing Sheets

DEVICE FOR ADJUSTING FLEXIBLE LATHS RELATIVE TO A BED FRAME

BACKGROUND OF THE INVENTION

This invention relates to a device for adjusting flexible laths relative to a bed frame.

Mattress-holders for flexible laths have been known in the art for a long time. Flexible laths may be constructed with varying stiffness. However, for determining spring force and comfort the kind of mattress should also be considered. Taking into account both of the above factors, lath flexibility and mattress structure, it is not possible to accurately adjust the whole unit to the user's requirements.

Since it is the mattress which first follows the body's shape; when the body exerts too high a pressure, for example level with the shoulders or the pelvis, the mattress holder, particularly the flexible laths, must adjust to the body shape. This is particularly true with thin or so-called soft mattresses which due to the constant load lose their spring action over time resulting in what is known as a "bedsore mattress". In thicker and so-called firm mattresses, the mattress-holder will have much less influence on following the body shape.

A prior art solution is disclosed in Swiss Pat. No. CH-625115. A plurality of laths are secured cross the width of the bed in a fixed groove forming a rigid structure. This lath structure has been satisfactory, however, this solution does not adjust to the changing displacement of body pressure during the night due to various sleeping positions. Due to their rigidness, the laths can not swing about the lengthwise axis of the bed and therefore can not adjust to body shifts. Therefore, the adaptability of the rest surface to the flowing line of the human body is strongly limited. Moreover, adjusting the laths to an accurate body profile is cumbersome requiring that the mattress must first be removed from the bed, the lath bottom must be raised from the bed and the laths must be slid completely out of the guideway for readjusting.

Accordingly, it is desirable to provide an improved lath which overcomes the drawbacks of the structure according to the above Swiss Patent.

SUMMARY OF THE INVENTION

Generally speaking in accordance with the invention, a lath support, receives at least one flexible lath end has a foot with at least two cavities therein provided above one another. A bearing secured to the bed frame has at least one pin which fits into one of the cavities. The lath support and bearing are positioned so that adjusting the height of the flexible lath relative to the bed frame is easily accomplished without altering the flexibility of the flexible laths and lath holder.

The support may also contain a middle skeleton forming a narrowed portion between the foot and the lath holder to allow the lath holder to deflect relative to the foot.

It is an object of this invention to provide an improved device for adjusting flexible lath relative to a bed frame.

Another object of this invention is to provide a support for flexible lath which allow the lath to adjust to shifts in body weight.

Still other objects and advantages of the invention will in part be obvious and will in part be apparent from the specification and drawings.

The invention accordingly comprises features of construction, combination of elements, and arrangement of parts which will be exemplified in the construction hereinafter set forth and the scope of the invention will be indicated in the claims.

DETAILED DESCRIPTION OF THE PREFERRED EMBODIMENT

Figure 1:
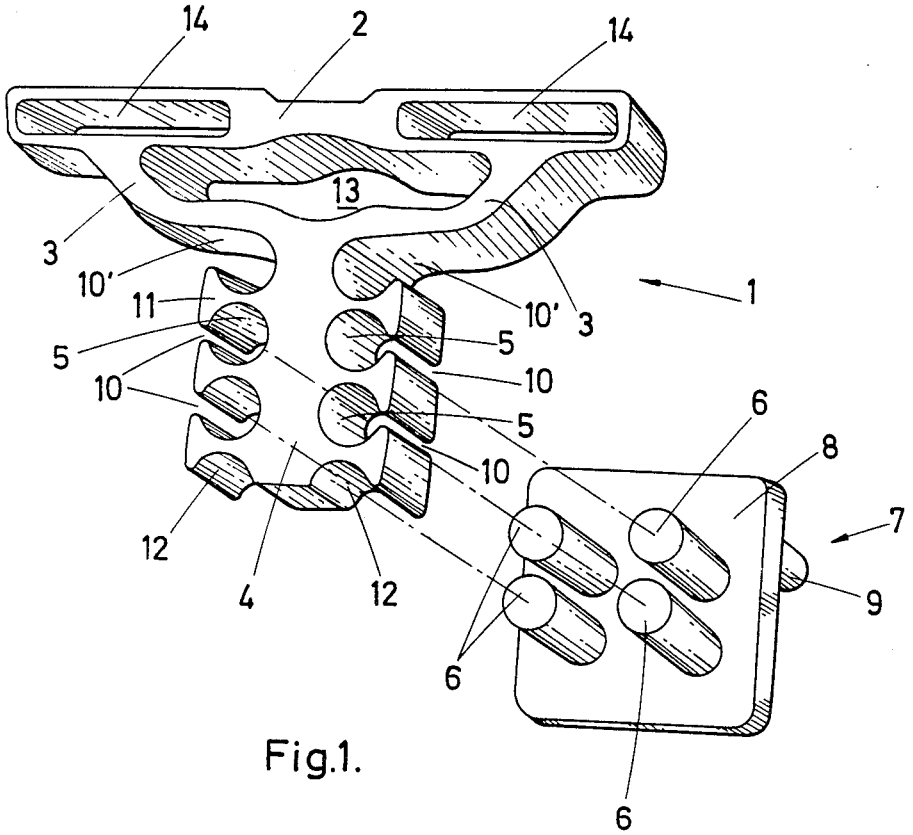
FIG. 1 is an exploded perspective view of a lath support in accordance with the invention.
Figure 4:
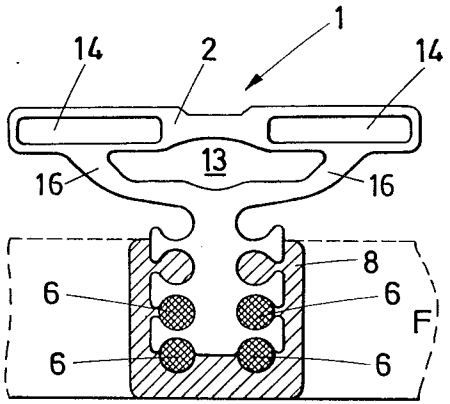
FIG. 4 is a front elevation of the lath support.
Figure 3:
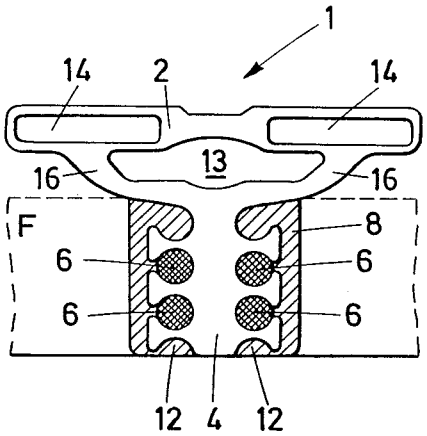
FIG. 3 is a front elevation view of the lath support.
Figure 2:
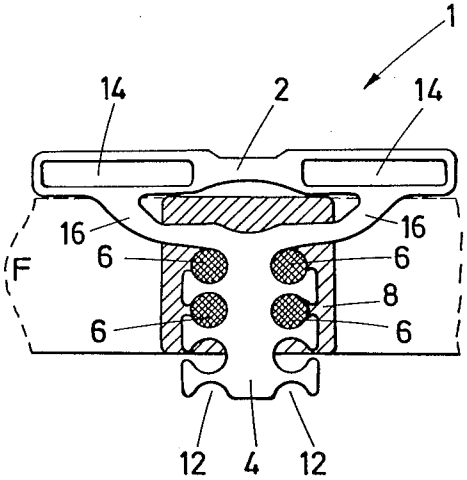
FIG. 2 is a front elevation view of the lath support.
Figure 5:
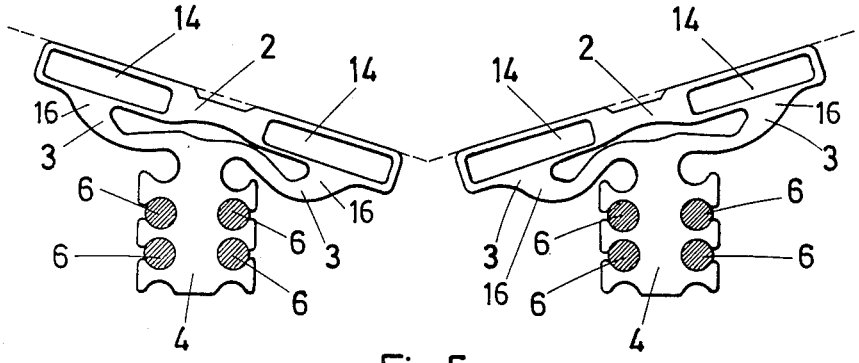
FIG. 5 is a front elevation view of two lath supports located next to one another.
Figure 6:
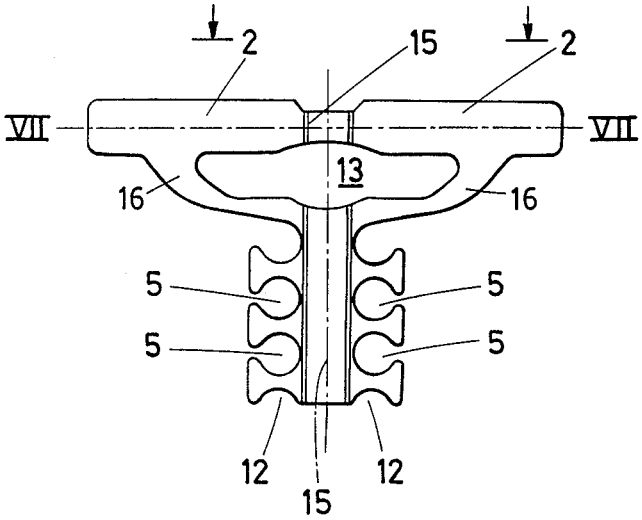
FIG. 6 is a rear elevation view of the lath support.
Figure 7:
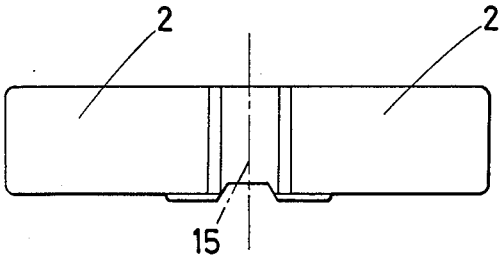
FIG. 7 is a top plan view along line VII—VII of FIG. 6.

Reference is made to FIGS. 2, 3 and 4 wherein a device for a bed frame F in having any shape or profile and made of any material provides the required means for receiving a lath support generally indicated as 1. Lath support 1 includes a lath holder 2 affixed above a middle skeleton 3 and a foot 4 descending from skeleton 3. Lath support 1 may be made from a flexible resilient material, for example, rubber.

Foot 4 is provided with a series of cavities 5 which can be slipped over a number of pins 6 extending from a bearing 7 affixed to frame F. Bearing 7 is made from a hard synthetic material and is constructed of a small plate 8 of any size and shape. Four pins 6 extend from one face of plate 8 and at least two ribbed pins 9 extend from the opposite face of plate 8 to ensure the linking with bed frame F. A simpler structure to support bearing 7 may be arranged with four pins 6 extending directly from bed frame F removing the need for plate 8 and ribs 9. However, this support is not as strong as the support utilizing pins 9.

Reference is now made to FIGS. 1, 5, 6 and 7, which show various pairs of cavity 5 are provided in foot 4. Each cavity 5 contains a slot 10. Between two adjoining slots 10, a claw 11 is formed in the material of foot 4.

Each cavity 5 has a diameter less than or equal to the diameter of pin 6, since the inner diameter of cavity 5 is smaller than or equal to the diameter of pin 6, a clamping action results. Beneath foot 4, two half-circle-shaped cavities 12 are provided for resting on pin 6 for support when support 1 is in a raised position. Uppermost cavities 5, which lie between foot 4 and middle skeleton 3, connect with the outer wall through an enlarged slot 10' along the outer side, in such a way that flexing of middle skeleton 3 relative to foot 4 is not prevented.

Middle skeleton 3, has a wide groove 13 extending there through forming side arms 16, on middle skeleton 3 which merge in the uppermost portion of skeleton 3 forming a lath holder 2. Lath holder 2 comprises two recesses 14 for each receiving one end of a flexible lath.

As discussed above foot 4 of lath support 1, is provided with at least three groups of cavity 5 pairs and two half-circle-shaped cavities 12 at the bottom of lath support 1. By moving cavity 5 pairs relative to bed frame F it is possible to adjust lath support 1 in one of at least three positions. (FIGS. 2, 3 and 4). The lowermost position of lath holder 2 is shown in FIG. 2. For increased stability Foot 4 is mounted on bearing 7 occurs by four pins 6.

The flexibility of each lath support 1 relative to a symmetry plane extending along the length of lath support 1 is very high. (FIG. 5) Due to the flexibility of middle skeleton 3, adjacent lath supports 1, may be adjusted so that lath holder 2 flexes at a great angle relative to the horizontal plane. The flexibility of lath support 1 and the adjustability of the height of lath support 7 relative to bed frame F as well as the use of flexible laths, allows the user to make adjustments to the mattress and mattress holder to match all of the pressure requirements of the body. Each individual user may thus obtain optimum sleeping comfort.

To facilitate simple adjustment of the mattress' rest profile and removal of lath support 1 from bearing 7, a continuous vertical groove 15 has been provided in the rear of foot 4 and lath holder 2. A flat item acting as a lever may be slipped into groove 15 to remove lath support 1 from bearing 7. It is thereby possible to adjust support 1 in any position as shown in FIGS. 2, 3 and 4, without removing the mattress and without raising the lath bottom from the bed.

Figure 8:
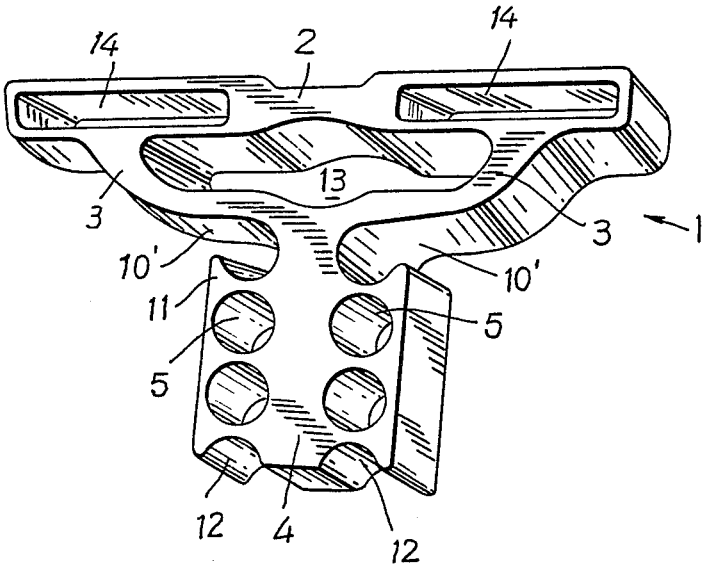
FIG. 8 is a front elevation of an alternative embodiment of the invention.

Reference is now made to FIG. 8 wherein an alternative embodiment is shown. In this embodiment it may be preferred to dispense with the clamping action of claws 11 and to let cavities 5 fit slidingly over pins 6.

It will thus be seen that the objects set forth above among those made apparent from the preceeding description are efficiently obtained and since changes may be made in the above construction without departing from the spirit and the scope of the invention, it is intended that all matters contained in the above description are shown in the accompanying drawings shall be interpreted as illustrative and not in limiting sense.

It is also to be understood that the following claims are intended to cover all the generic and specific features of the invention herein described and all statements of the scope of the invention which, as a matter of language might be said to fall therebetween.

I claim:

1. Device for adjusting flexible laths relative to a bed frame (F) which comprises in combination, a lath support (1) with at least one means for receiving one flexible lath end (2), and a bearing (7) to be secured to the bed frame (F), which has at least one pin (6) which fits in the one of at least two cavities (5) provided above one another of said lath support (1), in such a way that adjusting a flexible lath in the height relative to the bed frame (F) becomes possible.

2. Device as defined in claim 1, in which the bearing (7) to be secured to the bed frame is comprised of a small plate (8) which has on the one side, at least one pin (6) which is intended to fit into the one of at least two cavities (5) from said lath support (1), and on the other side, has at least one means (9) wherewith said small plate may be secured to the bed frame.

3. Device as defined in claim 1, in which said lath support (1) is essentially comprised of the following components:

(a) a foot (4) wherein said cavities (5) are provided, (b) a lath holder (2) wherein said means for receiving one flexible lath end is provided, and (c) a middle skeleton (3) which forms a narrowed portion between said foot (4) and lath holder (2) to allow said lath holder (2) flexing relative to said foot (4).

4. Device as defined in claim 3, in which the lath support (1) is made from a resilient material and said middle skeleton (3) has a recess (13) in the material to contribute to flexing of said lath holder relative to said foot (4).

5. Device as defined in claim 3, in which said lath holder (1) has two recesses (14) for receiving the ends of two flexible laths.

6. Device as defined in claim 3, in which underneath said foot, cavities are provided which lie open over the whole length thereof.

7. Device as defined in claim 1, in which said means for receiving a flexible lath end (14) is formed by an elongated recess.

8. Device as defined in claim 1, in which said foot (4) is provided with at least two groups of at least two cavities (5).

9. Device as defined in claim 1, in which all said cavities (5) in said foot (4) have sidewise a slot (10) running in parallel relationship with the center line of the cavity.

10. Device as defined in claim 1, in which all said cavities are closed sidewise.

11. Device as defined in claim 1, in which the lath support (1) has at least over most of the height thereof, a continuous vertical groove (15) in such a way that a flat item acting as a lever may be slipped into said groove to remove the lath holder (2) relative to said bearing (7).

* * * * *